US007306479B1

(12) United States Patent
Wu

(10) Patent No.: US 7,306,479 B1
(45) Date of Patent: Dec. 11, 2007

(54) CABLE CONNECTOR ASSEMBLY WITH STRAIN RELIEF MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,644

(22) Filed: Jul. 5, 2006

(51) Int. Cl.
*H01R 12/24* (2006.01)

(52) U.S. Cl. ..... 439/497; 439/610

(58) Field of Classification Search ..... 439/497, 439/610, 493, 490, 604, 924.1, 700, 101
See application file for complete search history.

(56) References Cited

U.S. PATENT DOCUMENTS

| | | | | | |
|---|---|---|---|---|---|
| 4,056,252 | A * | 11/1977 | Simon | 248/56 |
| 4,634,208 | A * | 1/1987 | Hall et al. | 439/610 |
| 4,917,629 | A * | 4/1990 | Matsuzaki et al. | 439/405 |
| 5,281,762 | A * | 1/1994 | Long et al. | 174/78 |
| 5,364,292 | A | 11/1994 | Bethurum | |
| 5,667,407 | A | 9/1997 | Frommer et al. | |
| 5,823,825 | A * | 10/1998 | Murphy | 439/610 |
| 5,906,513 | A * | 5/1999 | Peterson et al. | 439/607 |
| 6,165,006 | A * | 12/2000 | Yeh et al. | 439/490 |
| 6,231,392 | B1 * | 5/2001 | van Woensel | 439/610 |
| 6,287,149 | B1 * | 9/2001 | Elkhatib et al. | 439/610 |
| 6,290,530 | B1 * | 9/2001 | Chang | 439/378 |
| 6,431,902 | B1 * | 8/2002 | Yeh | 439/358 |
| 6,865,369 | B2 * | 3/2005 | Semmeling et al. | 434/357 |
| 2004/0067680 | A1 * | 4/2004 | Wu | 439/497 |
| 2004/0115988 | A1 * | 6/2004 | Wu | 439/497 |
| 2004/0147167 | A1 * | 7/2004 | Lai | 439/610 |
| 2005/0181661 | A1 * | 8/2005 | Kaneko et al. | 439/427 |

FOREIGN PATENT DOCUMENTS

| | | | |
|---|---|---|---|
| DE | 3743499 | C1 * | 12/1988 |
| EP | 282194 | A1 * | 9/1988 |

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

A cable connector assembly (100) comprises an insulative housing (2) defining a plurality of receiving passages (23) extending therethrough, a plurality of terminals (3) respectively received in the receiving passages (23), a circuit board (4) assembled to the insulative housing (2) and comprising a plurality of conductive pads soldering with said a plurality of terminals (3), a cable (6) electrically connecting with the circuit board (4) and comprising at least an inner conductor (60), a metal braiding layer (61) surrounding the inner conductor (60), a rear cover (7) assembled to the housing (2) to enclose rear portion of the housing, the circuit board (4) and front end of the cable (6), a strain relief member (5) assembled with the cable (6) and the circuit board (4) and comprising a main portion (50), a through hole (51) located at the middle section thereof and at least one jointing portion (52) formed on thereof; and wherein at least one jointing portion (52) of the strain relief member (5) is soldered onto one of the conductive pads of the circuit board (4), the inner conductor (60) passes through the through hole (51) to be soldered with the circuit board (4), the metal braiding layer (61) is solder onto the at least one jointing portion (52) of the strain relief member (5).

20 Claims, 13 Drawing Sheets

CABLE CONNECTOR ASSEMBLY WITH STRAIN RELIEF MEMBER

CROSS-REFERENCE TO RELATED APPLICATION

This application is related to U.S. patent application filed on Jul. 3, 2006 and entitled "CABLE CONNECTOR ASSEMBLY WITH STATUS INDICATOR MEANS", which has the same applicant and assignee as the present invention. The disclosure of related application is incorporated herein by reference.

BACKGROUND OF THE INVENTION

1. Field of the Invention

The present invention generally relates to a cable connector assembly, and more particularly to a cable connector assembly used for power transmission.

2. Description of Related Art

To connect a pair of connectors, a cable member is usually needed. Such a cable member generally comprises at least one inner conductor for signal transmission, a metal braiding layer enclosing the inner conductor for shielding the signal transmission and an outer jacket made from insulative material for protection. For achieving better signal transmission effect and reducing EMI in transmission, the metal braiding layer usually electrically connects with a single cable holder which electrically connects with a conductive shell, as disclosed in U.S. Pat. No. 5,364,292, thus, reducing EMI. The metal braiding layer also can be grasped by a strain relief area of a conductive shell to form electrical connection, thus, reducing EMI in signal transmission, as disclosed in U.S. Pat. No. 5,667,407. However, in some circumstances, the connecting manners as described above are not suitable, a new design is needed to fit different applications.

BRIEF SUMMARY OF THE INVENTION

Accordingly, an object of the present invention is to provide a connector assembly with improved strain relief with simple structure and low cost for achieving more reliable connection.

In order to achieve the above-mentioned object, a cable connector assembly in accordance with the present invention comprises an insulative housing defining a plurality of receiving passages extending therethrough, a plurality of terminals respectively received in the receiving passages, a circuit board assembled to the insulative housing and comprising a plurality of conductive pads soldering with said a plurality of terminals, a cable electrically connecting with the circuit board and comprising at least an inner conductor, a metal braiding layer surrounding the inner conductor, a rear cover assembled to the housing to enclose rear portion of the housing, the circuit board and front end of the cable, a strain relief member assembled with the cable and the circuit board and comprising a main portion, a through hole located at the middle section thereof and at least one jointing portion formed on thereof; and wherein at least one jointing portion of the strain relief member is soldered onto one of the conductive pads of the circuit board, the inner conductor passes through the through hole to be soldered with the circuit board, the metal braiding layer is solder onto the at least one jointing portion of the strain relief member.

Other objects, advantages and novel features of the invention will become more apparent from the following detailed description of the present embodiment when taken in conjunction with the accompanying drawings.

DETAILED DESCRIPTION OF THE INVENTION

Figure 1:
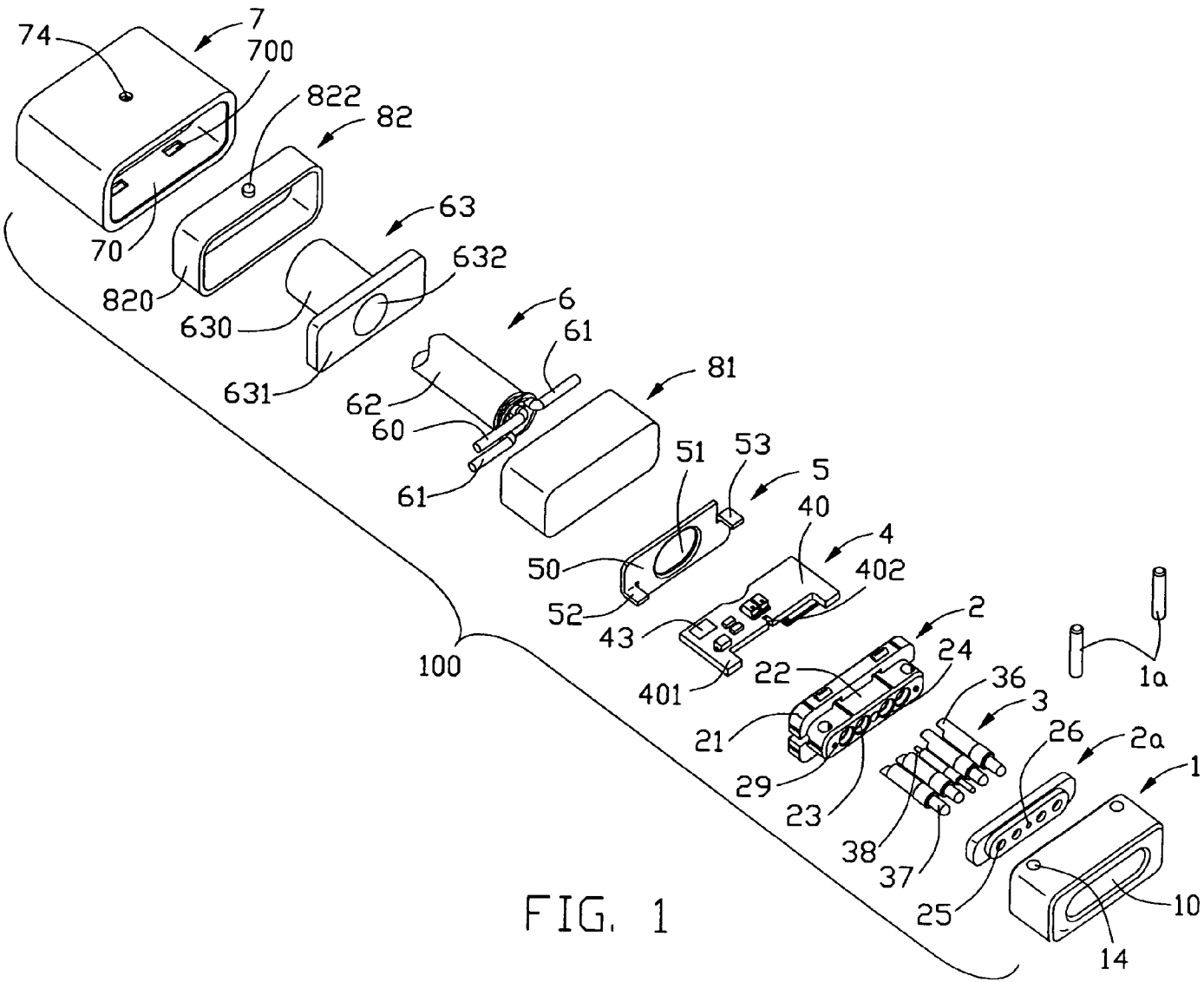
FIG. 1 is an exploded, perspective view of a cable connector assembly in accordance with the present invention.

Reference will now be made to the drawing figures to describe the present invention in detail.

Referring to FIGS. 1-4, a cable connector assembly 100 in accordance with the present invention comprises an insulative housing 2, a plurality of conductive terminals 3 received in the housing 2, a circuit board 4 assembled to the housing 2, a strain relief member 5 assembled to and electrically connecting with the circuit board 4, a cable 6 electrically connecting with the strain relief member 5 to achieve the electrical connection with the circuit board 4, front and rear covers 1, 7 respectively assembled to the housing 2 and together enclosing the elements mentioned above therebetween.

Figure 3:
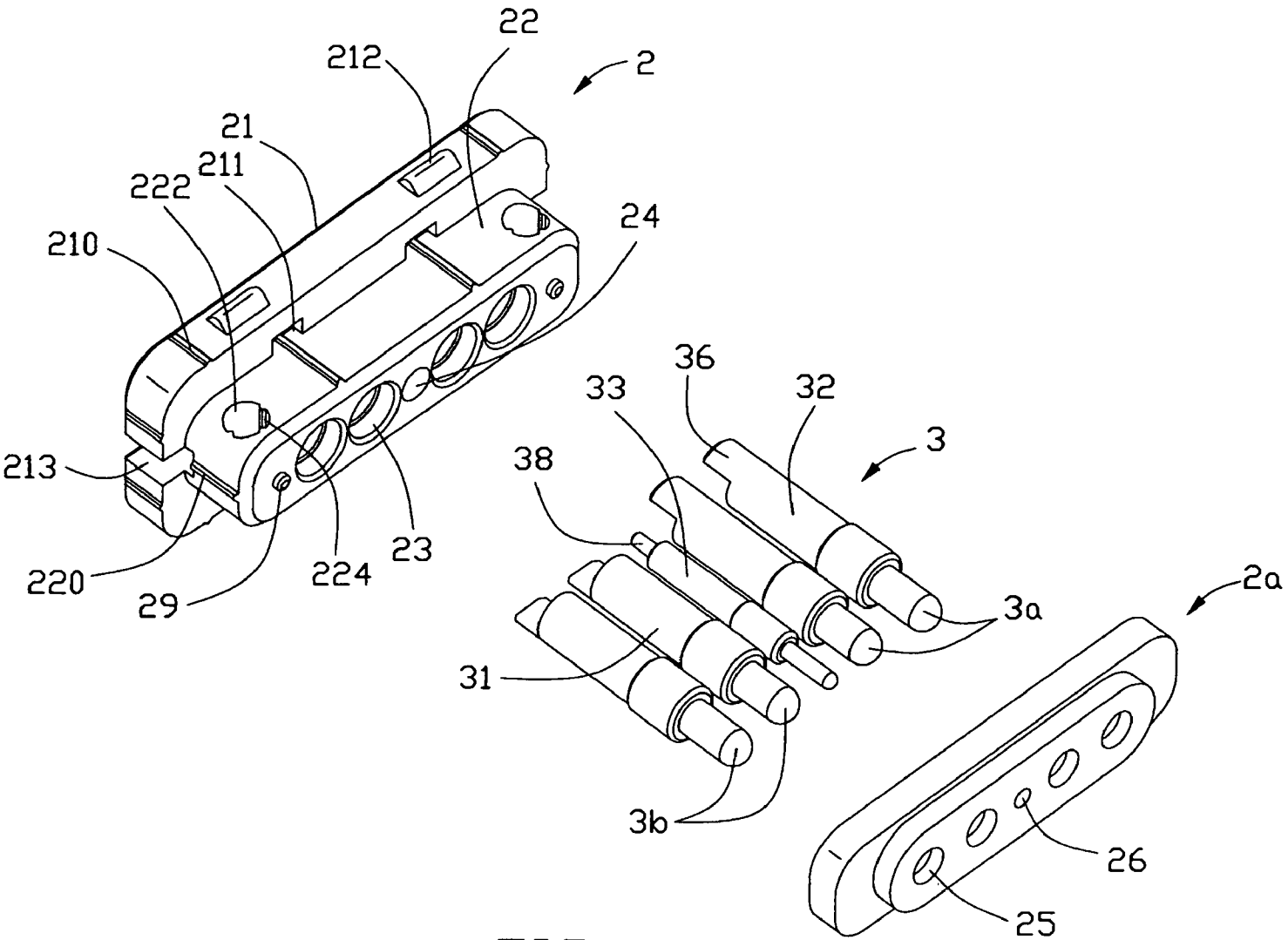
FIG. 3 is a partially exploded view of FIG. 1.
Figure 4:
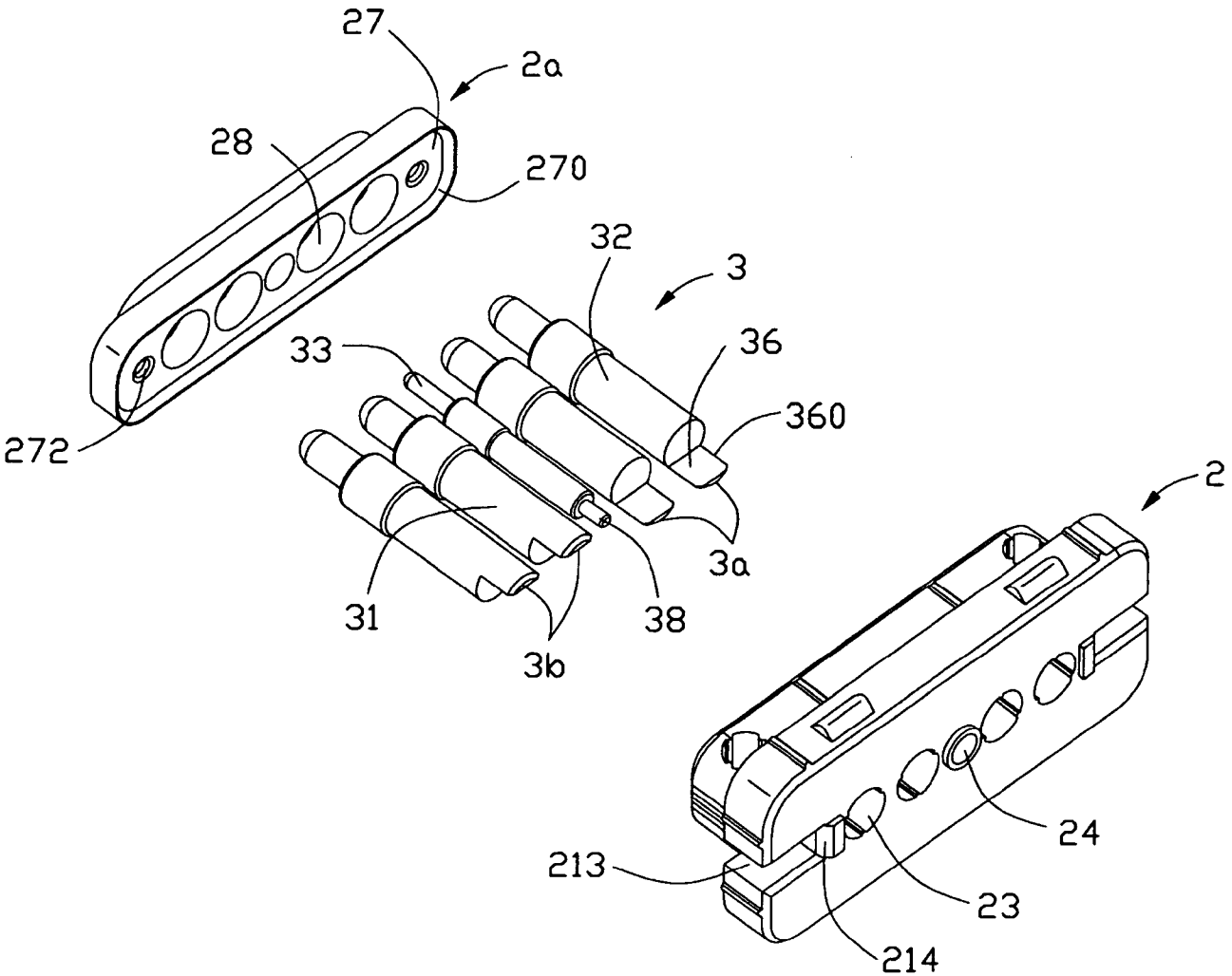
FIG. 4 is a view similar to FIG. 3, but viewed from a different aspect.

Please refer to FIGS. 3-4, the housing 2 comprises a base portion 21 and a tongue portion 22 extending forwardly from the base portion 21. The housing 2 defines two pairs of large-size first receiving passages 23 and a center small-size second receiving passage 24 respectively recessed from a front face of the tongue portion 22 to a rear face of the base portion 21. Each passage 23, 24 is formed with a relatively larger dimension in a front portion thereof and a relatively smaller dimension in remaining portion thereof. The base portion 21 forms a plurality of first friction ribs 210 arranged on outer periphery of the base portion 21 with an interval and extending along a front-to-back direction. A pair of tapered protrusions 212 is respectively formed on each of the upper and lower surfaces of the base portion 21. The base portion 21 defines two pairs of rectangular first slots 211 spaced arranged in upper and lower walls and respectively recessed from the front face to the rear face thereof with determined distance from respective top and bottom surfaces. The base portion 21 also defines a pair of second slots 213 extending along the front-to-back direction to communicate the front face with opposite rear face and recessed inwardly from opposite lateral walls thereof. A pair of tapered protrusions 214 are formed on the rear face of the base portion 21 and locate adjacent to corresponding second slots 213 for facilitating the insertion of the circuit board 4. The tongue portion 22 defines a pair of circular first engaging holes 222 extending therethrough along up-to-down direction and forms a pair of second friction ribs 220 on opposite lateral walls thereof extending along the front-to-back direction. Each engaging hole 222 forms a pair of ribs 224 protruding outwardly from inner periphery thereof. A pair of positioning posts 29 protrude forwardly from the front surface of the tongue portion 22 and are spaced arranged adjacent to opposite lateral walls of the tongue potion 22.

Now referring to FIGS. 1-4, the conductive terminals 3 consist of a pair of ground terminals 32, a pair of power terminals 31 located between the pair of ground terminals 32 and a center detective terminal 33 located between the pair of power terminals 31. Thus, we can designate a first set of terminals 3*a* and a second set of terminals 3*b*. Each terminal 3 is of a POGO Pin type, that is to say, there is a spring (not shown) inside the terminal 3, thus, when mating, the terminal 3 can be pressed to rearward move along the mating direction. Each ground terminal 32 comprises a column-shape contacting portion 37 with a relatively small diameter, a column-shape media portion 35 with a relatively large diameter, and an end portion 36 formed at rear end of the media portion 35 with an arc-shape and comprising a flat engaging surface 360. A front engaging section 350 protrudes outwardly from outer periphery of the media portion 35. The power terminal 31 has the same structure as that of the ground terminal 32 except the contacting portion 37 thereof has a length shorter than that of the ground terminal 32. The detective terminal 33 has the same structure as that of the ground terminal 32 except each portion thereof has a smaller diameter than that of the ground terminal 32. In addition, the end portion 38 of the detective terminal 33 is of columnar-shape.

Figure 2:
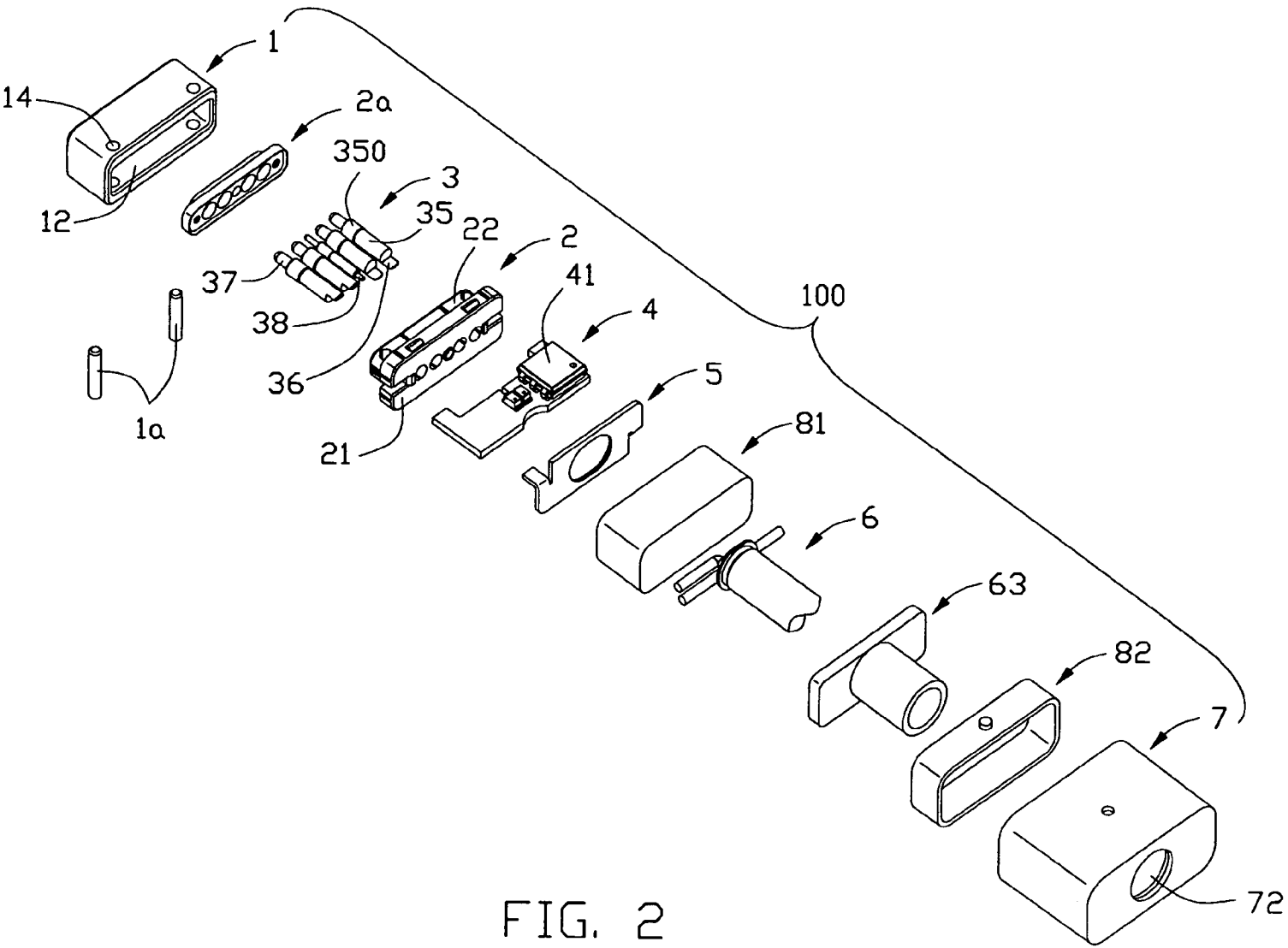
FIG. 2 is a view similar to FIG. 1, but viewed from a different aspect.

Referring to FIGS. 1-2, the circuit board 4 comprises a substrate 40 formed with a power conductive pad 43 and opposite ground conductive pads (not shown), and a pair of LEDs 42 arranged on opposite sides of the substrate 40 and located adjacent to rear edge thereof with non-aligning relationship along vertical direction. The circuit board 4 may be equipped with an IC 41 for driving the LEDs 42 to emit light. The substrate 40 comprises a pair of stretching arms 401 extending forwardly from opposite lateral sides thereof.

The strain relief member 5 is die punched from metal material or other conductive material with thin thickness. The strain relief member 5 comprises a rectangular main portion 50 defining an elliptical-shape through hole 500 in a center thereof. The main portion 50 further defines a pair of jointing portions 52, 53 respectively formed on the two sides of thereof. The jointing portion 52 is punched from the bottom of the main portion 50 and then extends horizontally away from the main portion 50 in a back-to-front direction, and in reverse, the jointing portion 53 is punched from the top of the main portion 50 and then extends horizontally away from the main portion 50 in the back-to-front direction.

The cable 6 comprises an inner conductor 60, a metal braiding layer 61 surrounding the inner conductor 60, and an outer jacket 62 enclosing the metal braiding layer 61. A front portion of the outer jacket 62 is stripped to expose part of the inner conductor 60 and the metal braiding layer 61. In this embodiment, the exposed portion of the metal braiding layer 61 is divided into two parts corresponding to the jointing portions 52, 53 of the strain relief member 5. The cable 6 may be equipped with a stuffing member 63 integrally made from resin material. The stuffing member 63 comprises a circular portion 630, a rectangular enlarged panel 631 formed at front end of the main portion 630 and a through hole 632 communicating with the circular portion 630 and the enlarged panel 631. The stuffing member 63 is capable of cosmetizing the back-view of the cable connector assembly and protecting the cable 6 adjacent to the rear cover 7 from bending.

Figure 9:
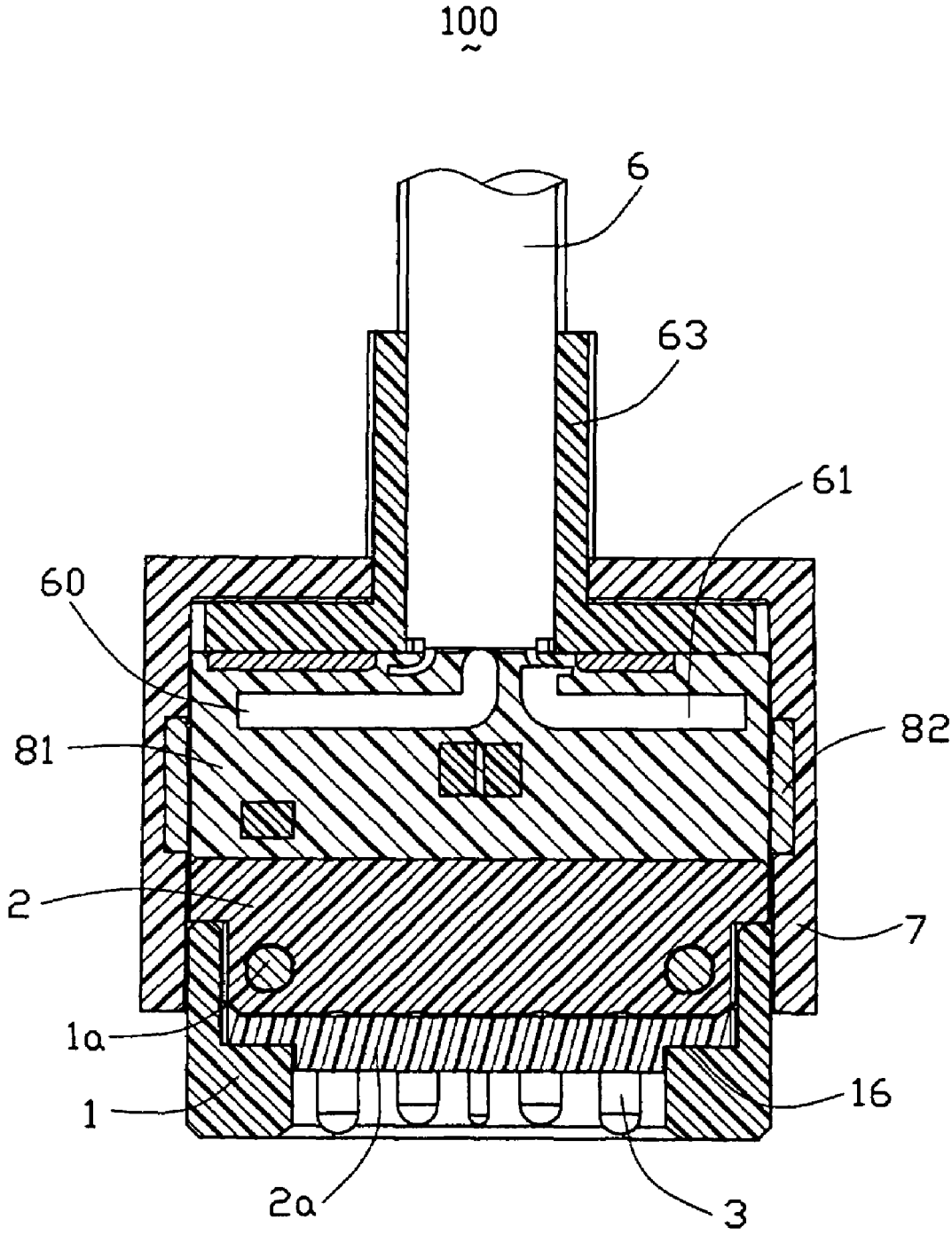
FIGS. 9-13 are cross-section views taken along lines 9-9 to 13-13 of FIG. 7.

The front and rear covers 1, 7 are respectively assembled to the housing 2. The front cover 1 is made from conductive material capable of being attracted by a complementary connector. The front cover 1 defines an elliptical-shape front receiving cavity 10 recessed rearwardly from a front surface thereof for receiving the complementary connector and a rectangular rear receiving passage 12 recessed forwardly from a rear surface thereof to communicate with the front receiving cavity 10 for receiving the housing 2. The receiving passage 12 has a large size along a lateral direction of the front cover 1 than that of the receiving cavity 10, thus, forming a pair of step portions 16 therebetween (FIG. 9). The front cover 1 also defines a pair of circular second engaging holes 14 respectively recessed from a top surface to opposite rear surface thereof and locating adjacent to the rear surface thereof. The rear cover 7 is made from resin material and of rectangular shape.

The cable connector assembly 100 also comprises status indicator means (not labeled) made of transparent material or semitransparent material and comprising a pair of LEDs 42 for spreading the light, an inner casing 81 molded with the strain relief member 5 and the housing 2, and a light pipe 82 partially surrounding the inner casing 81 to spread the light permeated from the inner casing 81 outwardly for indicating the normal status of the cable connector assembly 100. The inner casing 81 is molded or injected from transparent or semitransparent material. The light pipe 82 is molded or injected from transparent or semitransparent material and comprises a belt-shape body section 820 and a pair of post-shape positioning sections 822 extending outwardly from a center of the upper wall and the lower wall of the body section 820.

The cable connector assembly 100 is further equipped with a cosmetic member 2*a* assembled to the housing 2 for cosmeticizing the visual effect of front portion of the cable connector assembly 100. The cosmetic member 2*a* is of step-shape and defines four first channels 25 and a second channel 25 corresponding to the first receiving passages 23 and the second receiving passage 24 of the housing 2 with dimensions corresponding to the diameters of the contacting portions 37 of the terminals 3. An entranceway 27 is recessed forwardly from a rear surface of the cosmetic member 2*a*, thus, forming an inner front face 270. A plurality of different-size passageways 28 recess forwardly from the inner front face 270 to communicate with corresponding first and second channels 25, 26 with dimensions corresponding to the diameters of the engaging sections 350 of the terminals 3. A pair of positioning recesses 272 also recesses forwardly from the inner front face 270 and locates at opposite sides of the cosmetic member 2*a*. Corresponding to the structures of the cosmetic member 2*a*, a front end of the tongue portion 22 is tapered to form a slant edge along outer periphery thereof for facilitating the assembly of the cosmetic member 2*a* and received in the entranceway 27.

Figure 5:
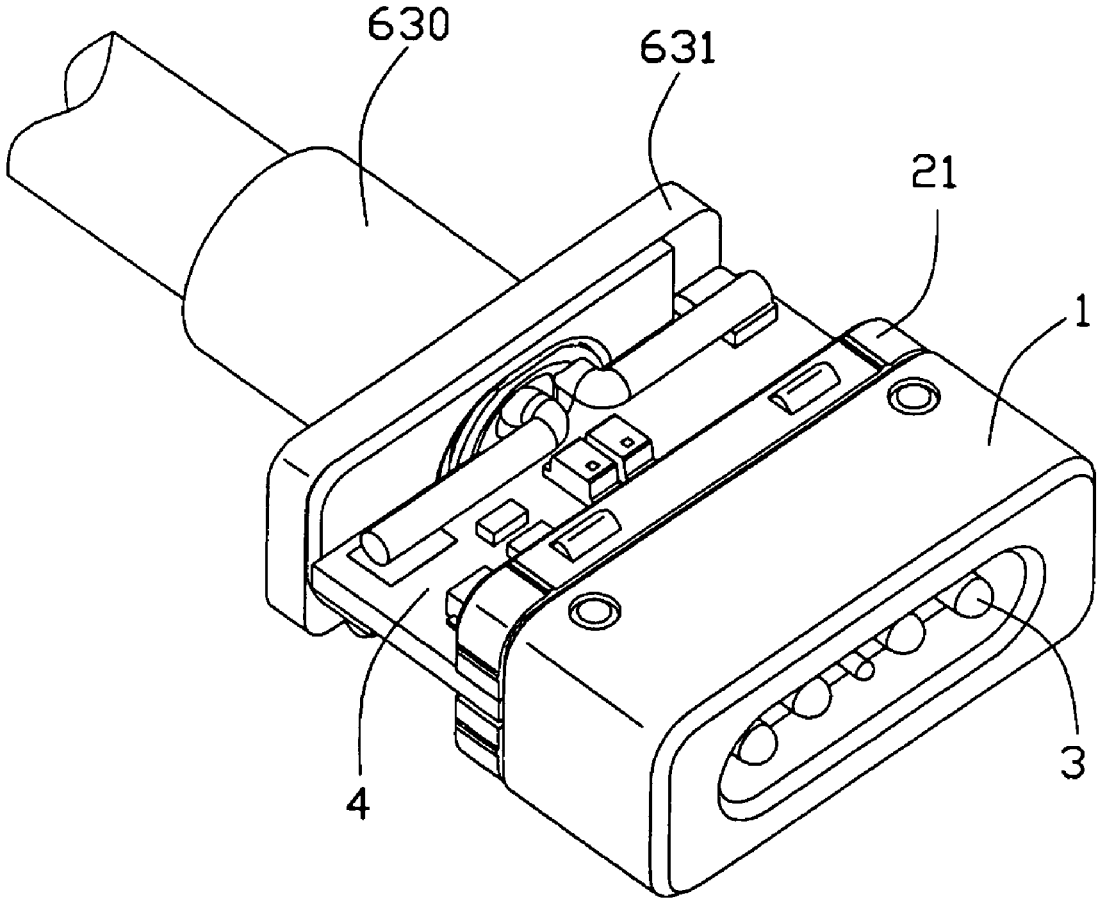
FIG. 5 is a partially assembled view of FIG. 1.
Figure 6:
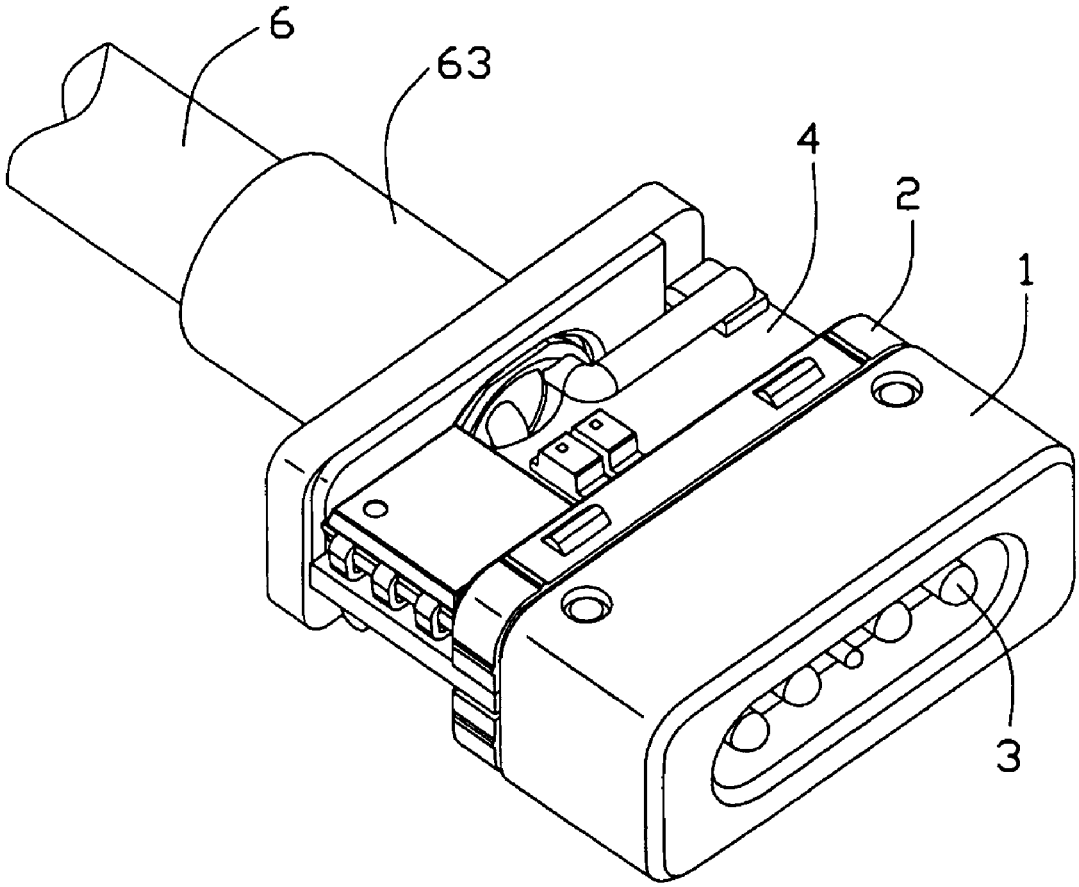
FIG. 6 is a view similar to FIG. 5, but viewed from a different aspect.
Figure 7:
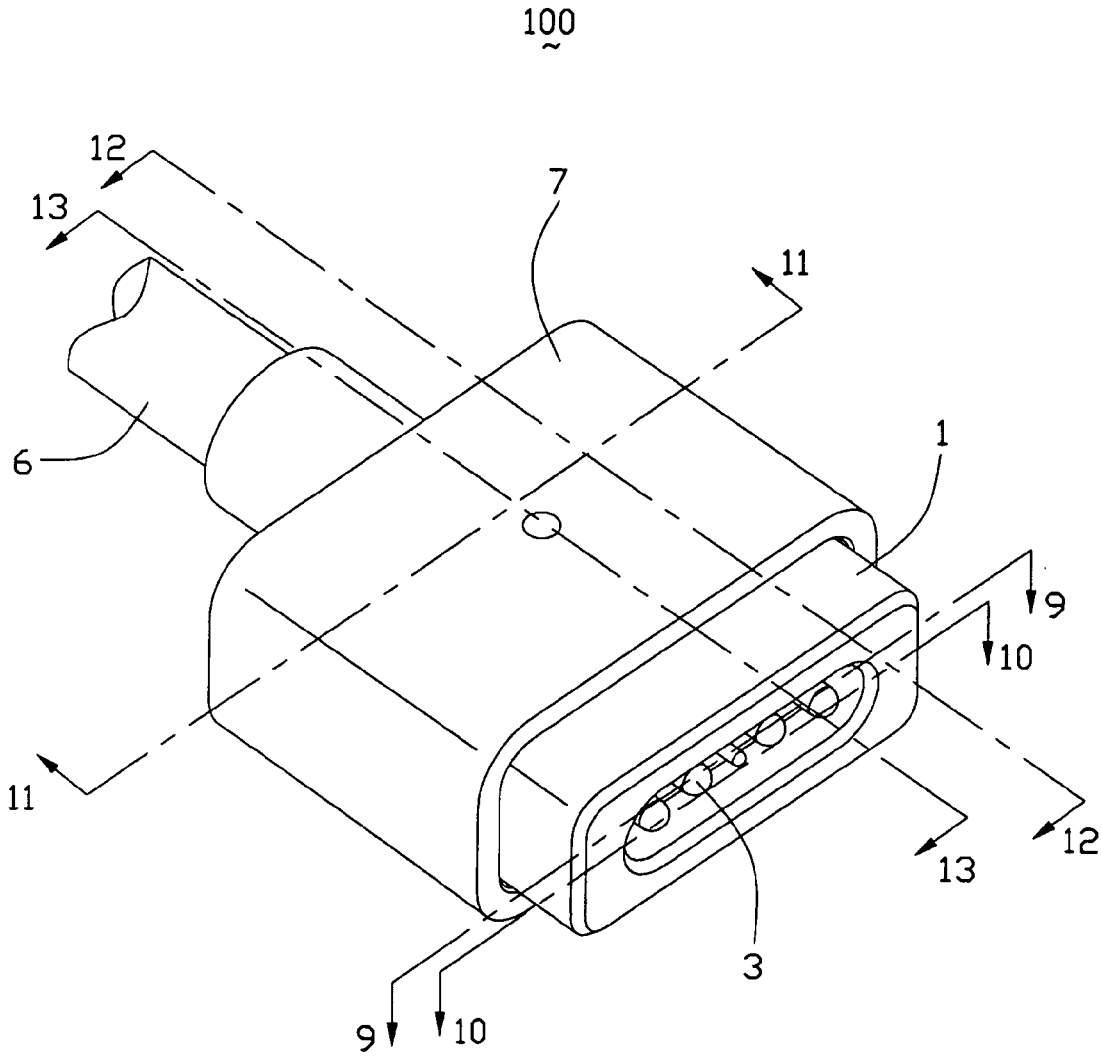
FIG. 7 is an assembled, perspective view of the cable connector assembly shown in FIG. 1.
Figure 8:
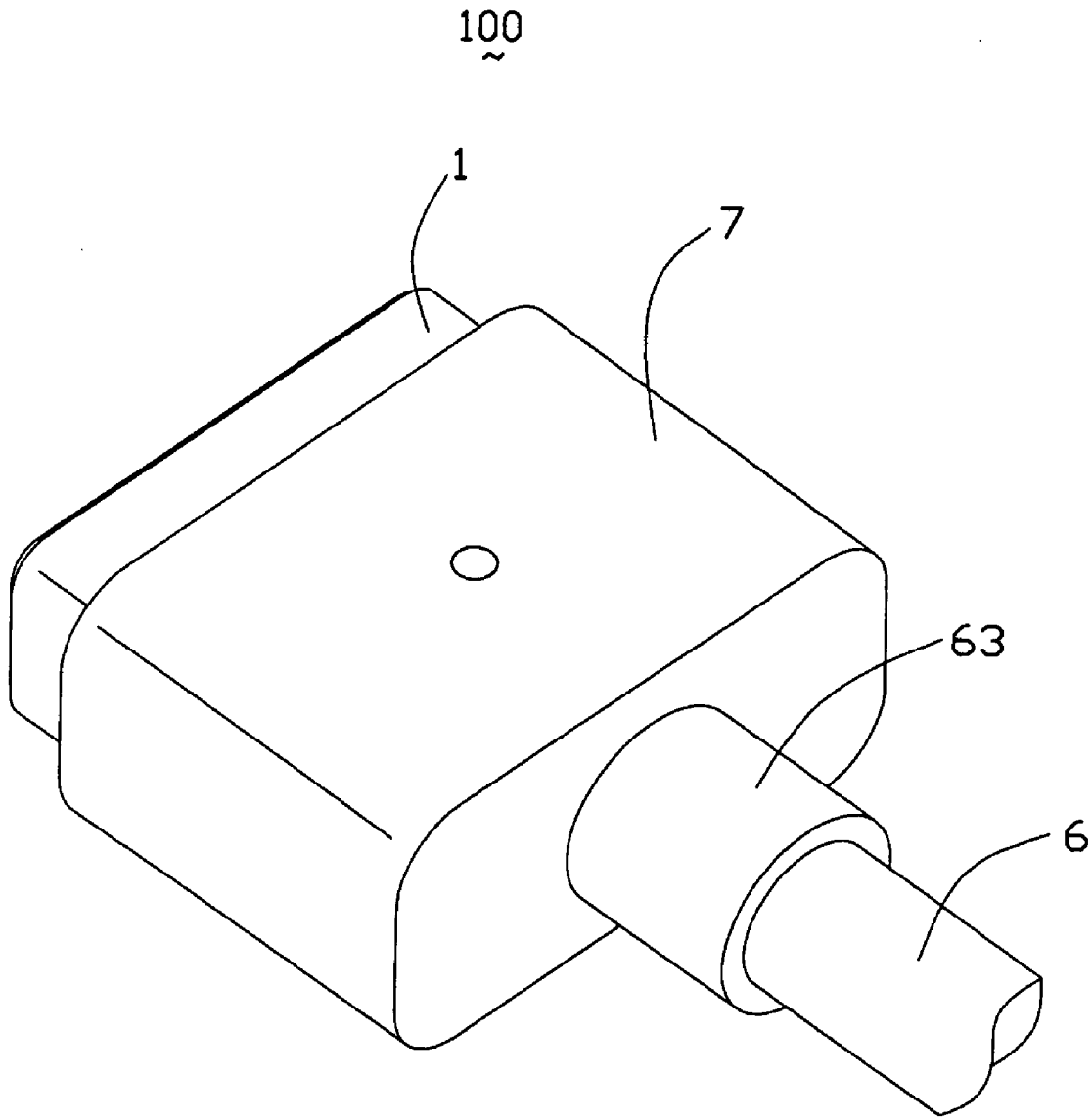
FIG. 8 is a view similar to FIG. 7, but viewed from a different aspect.
Figure 11:
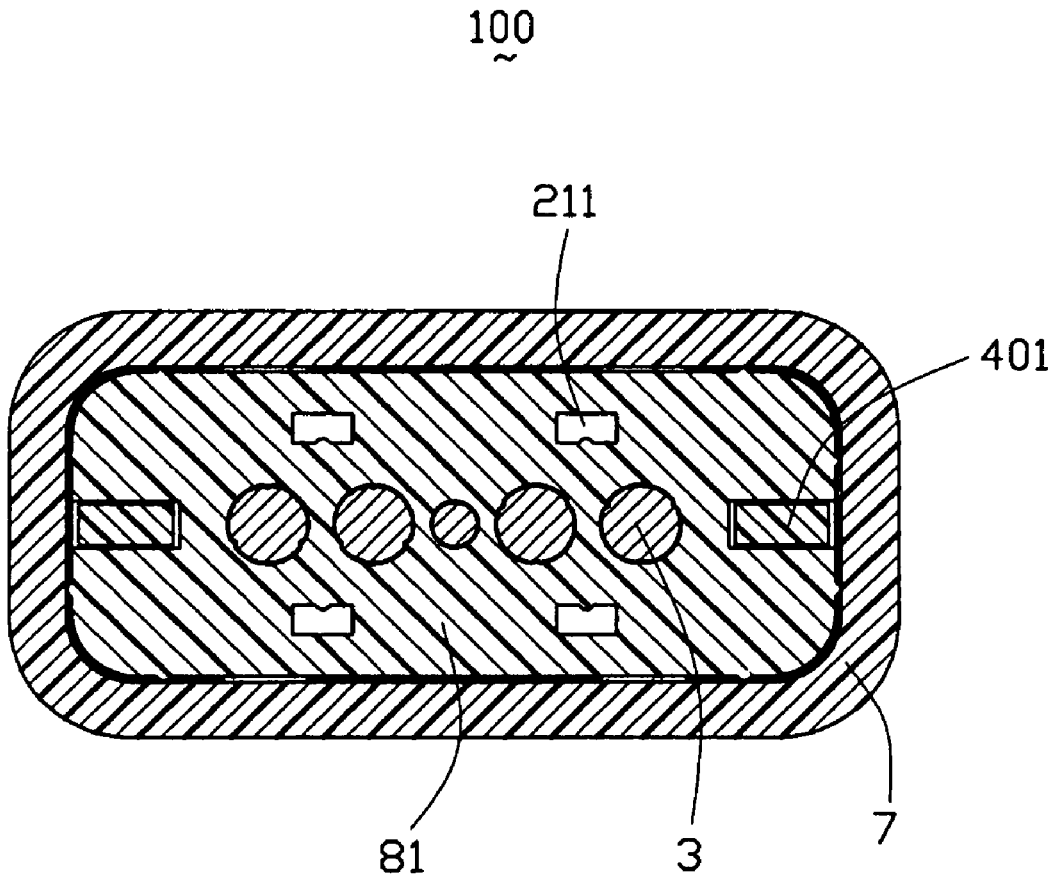
Figure 12:
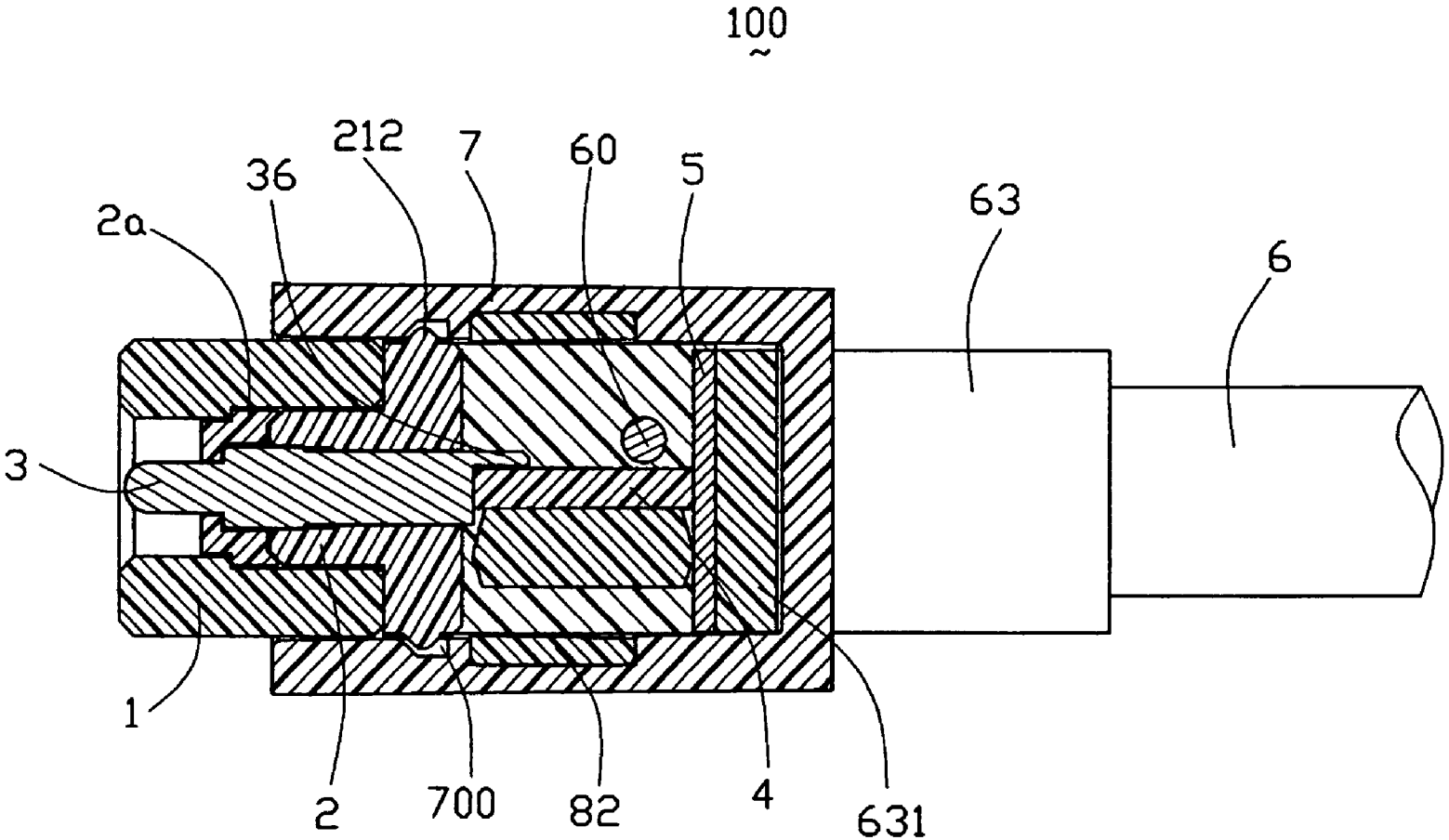
Figure 13:
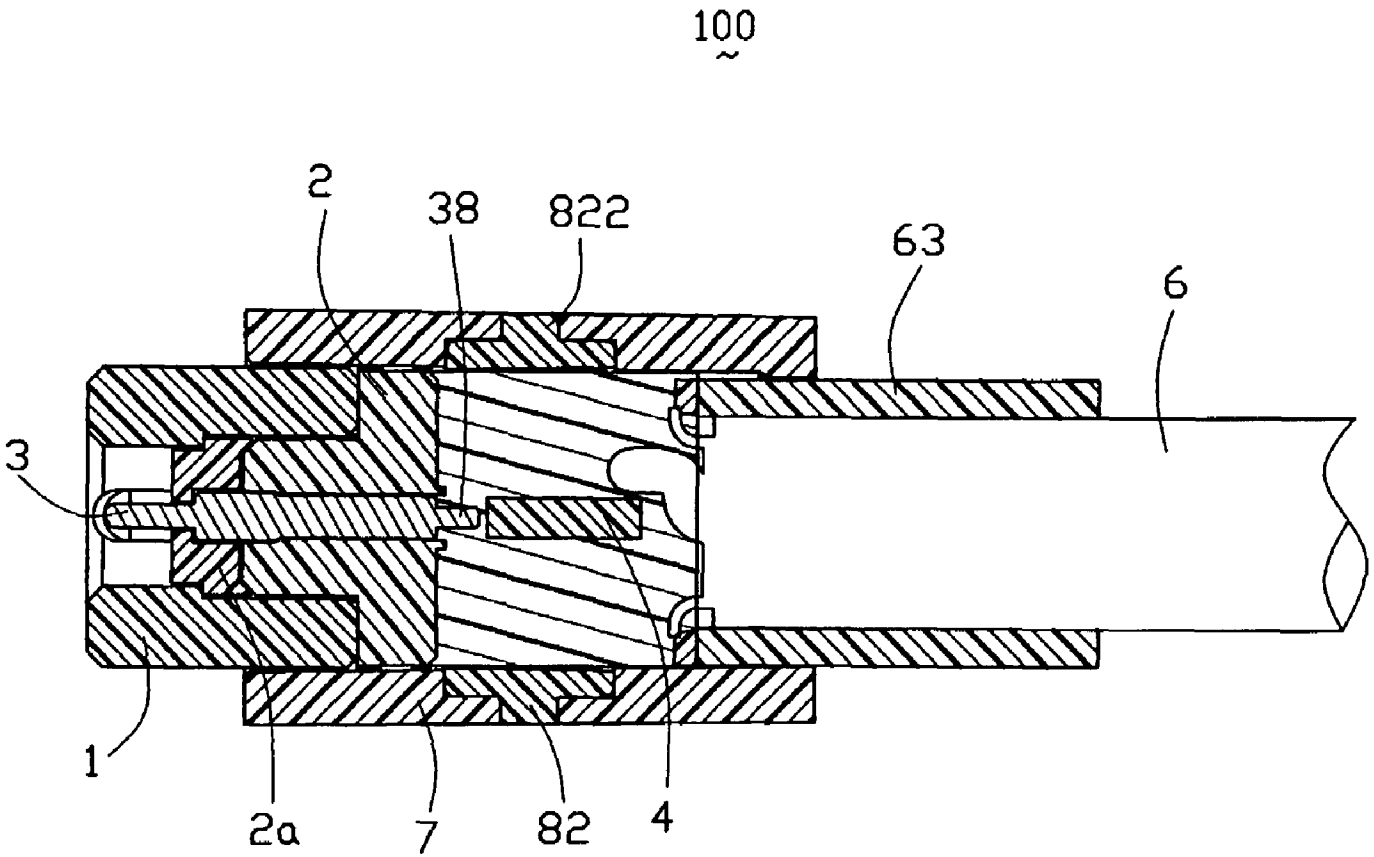

Referring to FIGS. 3-5 in conjunction with FIGS. 7-8 and 11, in assembly, the conductive terminals 3 are assembled to the housing 2 with the media portions 35 of the power terminals 31, ground terminals 32 and the detective terminal 33 respectively received in corresponding first and second receiving passages 23, 24, front parts of the engaging sections 350 and the contacting portions 37 exposed beyond the front surface of the housing 2. The end portions 36 of the power and ground terminals 31, 32 are respectively extend beyond the rear surface of the housing 2, and the end portion 38 of the detective terminal 33 also extends beyond the rear surface of the housing 2. The end portions 36 of the power and ground terminals 31, 32 spaced by the detective terminal 33 are arranged opposite to each other for soldering onto the upper and lower surfaces of the circuit board 4.

The cosmetic member 2*a* is assembled to the housing 2 and the terminals 3. The pair of positioning posts 29 is respectively received in the positioning recesses 272 of the cosmetic member 2*a* for positioning the right position of the cosmetic member 2*a* and the front edge of the tongue portion 22 is received in the entranceway 27. After the cosmetic member 2*a* is assembled to the housing 2 and the terminals 3, the front portions of the engaging sections 350 exposed outside of the housing 2 and the contacting portions 37 of the terminal 3 are respectively received in the passageways 28 and the first and second channels 25, 26, thus, the cosmetic member 2*a* not only can further retain the terminals 3, but also can improve the front visual effect.

Figure 10:
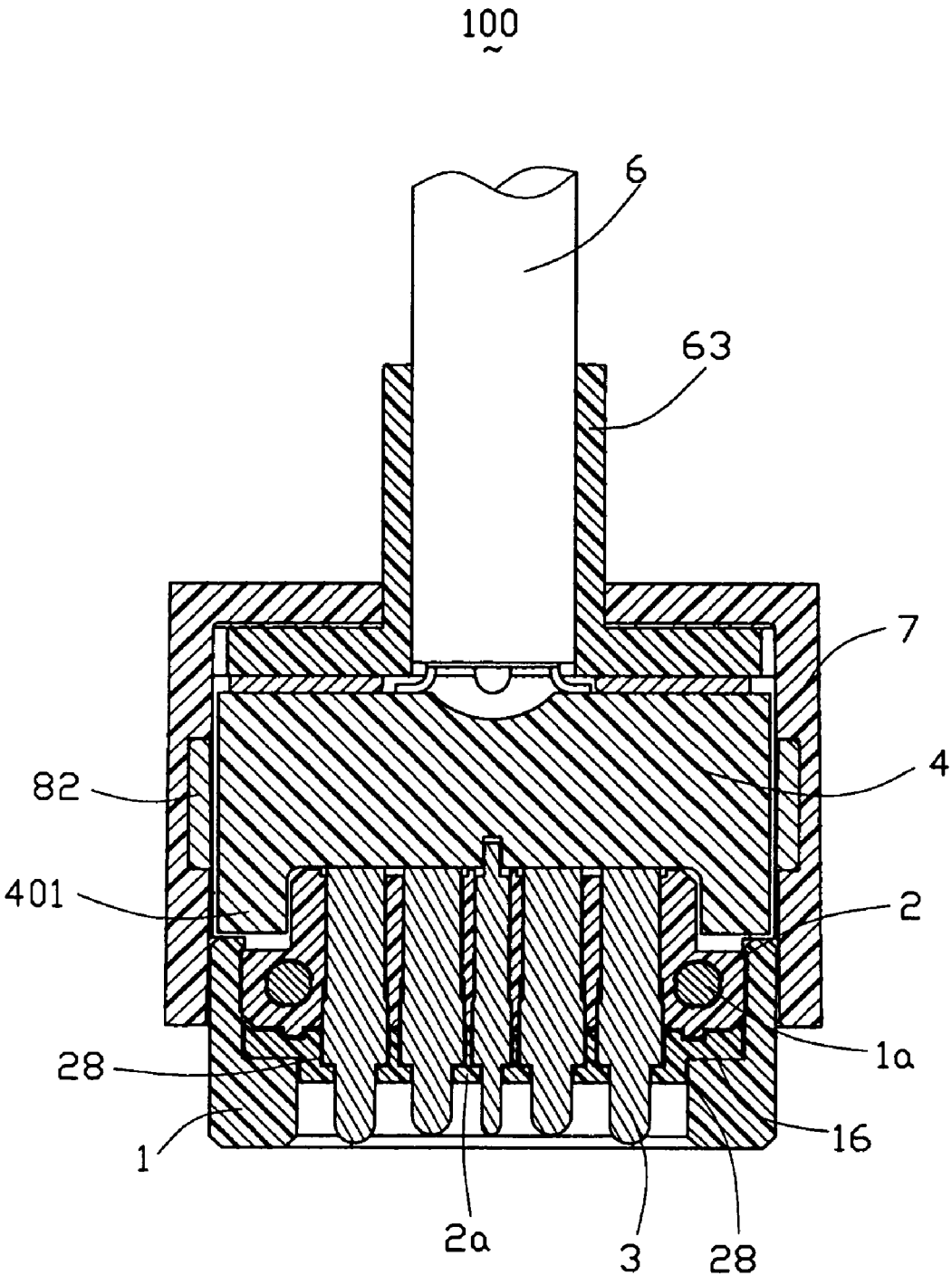

Then referring to FIGS. 1-4 in conjunction with FIGS. 9-10, the front cover 1 is assembled to the housing 2 via a pair of pins 1*a*. The tongue portion 22 with the cosmetic member 2*a* is firstly inserted into the receiving passage 12 of the front cover 1 until the front surface of the cosmetic member 2*a* abuts against the step portion 16 of the front cover 1 and the base portion 21 abuts against a rear surface of the front cover 1. Thus, the tongue portion 22 is frictionally received in the receiving passage 12 of the front cover 1 by means of the pair of second friction ribs 220. Furthermore, the contacting portions 37 are exposed in the receiving cavity 10 with tip ends of the ground terminals 32 substantially coplanar with a front surface of the front cover 1. The pair of first engaging holes 222 respectively align with the pair of second engaging holes 14 of the front cover 1 in the vertical direction, thus, the pair of pins 1*a* respectively inserts through the second engaging holes 14 and the first engaging holes 222 to position the front cover 1 relative to the housing 2. Of course, the engagement between the front cover 1 and the housing 2 also can be realized by other means, such as using glue, latch means et al.

Then, referring to FIGS. 1-2 in conjunction with FIGS. 9-10 and 12-13, the circuit board 4 is assembled to the housing 2 and electrically connects with the end portions 36, 38 of the power terminals 31, the ground terminals 32 and the detective terminal 33 for forming electrical connection with the terminals 3. For reaching a better engaging effect, the flat surfaces 360 of the end portions 36 of the first set of the terminals 3*a* engage on the top surface of the circuit board 4, whereas the flat surfaces 360 of the end portions 36 of the second set of the terminals 3*b* engage on the bottom surface of the circuit board 4. The end portion 38 of the detective terminal 33 is received in a slit 402 rearward extending from a middle of a front edge of the circuit board 4 to directly electrically connect with the pair of LEDs 42. The pair of stretching arms 401 is respectively received in the second slots 213 with the guidance of the pair of tapered protrusions 214.

Now referring to FIGS. 1-2 in conjunction with FIGS. 5-6 and 9-13, the cable 6 is firstly assembled to the strain relief member 5 then assembled to the circuit board 4 together with the strain relief member 5. The inner conductor 60 protrudes through the through hole 51 of the strain relief member 5, and the two parts of the metal braiding layer 61 firstly solder onto the jointing portions 53, 54 to form electrical connection with the strain relief member 5. The strain relief member 5 is assembled to a rear end of the circuit board 4 with the jointing portions 52, 53 thereof respectively soldered with the opposite ground conductive pads (not shown) disposed on upper and lower surfaces of the circuit board 4 and the inner conductor 60 soldered with the power conductive pad located on either one of the upper or lower surface of the circuit board 4. Therefore, the electrical connection between the cable 6 and the circuit board 4 further with the terminals 3 is established. The stuffing member 63 is assembled to the cable 6 from a rear-to-front direction with the front end of the cable 6 received in the circular portion 630. Thus, the stuffing member 63 is capable of cosmetizing the visual effect of the front portion of the cable connector assembly 100.

Referring to FIGS. 1-2 in conjunction with FIGS. 5-13, the cable connector assembly 100 forms the inner casing 81, the light pipe 82 and the rear cover 7 by means of injection or molding. Particular to FIG. 5, firstly, the inner casing 81 is molded from transparent or semitransparent material between a receiving space defined by the enlarged panel 631 and the base portion 21, and the inner casing 81 can reinforce the stabilization of the afore assembled assembly. Secondly, the light pipe 82 is molded from transparent or semitransparent material. Lastly, the rear cover 7 is molded over the light pipe 82 to receive the light pipe 82 therein. The rear cover 7 defines a receiving cavity 70 recessed rearwardly from a front surface thereof to communicate with a stepped receiving passage 72 in a rear edge thereof. The belt-shape body section 820 is received in a middle annular passage (not labeled) recessed outwardly from inner periphery of the rear cover 7 with the pair of positioning sections 822 respectively received in a pair of circular receiving holes 74 in upper and lower surfaces of the rear cover 7 to be exposed outside for indication. Then, the light pipe 82 and the rear cover 7 together assembled to the assembly described above with a rear end of the front cover 1, the base portion 21 of the housing 2, the inner casing 81, the strain relief member 5, and the front end of the cable 6 received in the receiving cavity 70 of the rear cover 7. Corresponding to the protrusions 212 formed on upper and lower surfaces of the base portion 21 of the housing 2, the rear cover 7 forms two pairs of cutouts 700 (FIG. 12) to receive the protrusions 212 therein for increasing the retaining force between the housing 2 and the rear cover 7. The positioning sections 822 of the light pipes 82 to spread the light emitting from the LEDs 42 to outside for indication. In addition, the enlarged stuff portion 632 is stopped by the stepped receiving passage 72 with the circular portion 630 exposed beyond the rear cover 7.

Once the cable connector assembly 100 mates with the complementary connector normally, the LEDs 42 emit light outwardly, and the light may permeate through the inner casing 81 then to the light pipe 82 to indicate the user the normal status of the cable connector assembly 100. In the embodiment of the present invention, the strain relief member 5 is punched from a metal sheet with simple structure, thus, low cost and space-spare are achieved accordingly. In addition, the improved strain relief structure is capable of achieving more reliable connection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing defining a plurality of receiving passages extending therethrough;

a plurality of terminals respectively received in the receiving passages;

a circuit board assembled to the insulative housing and comprising a plurality of conductive pads soldering with said a plurality of terminals;

a cable electrically connecting with the circuit board and comprising at least an inner conductor, a metal braiding layer surrounding the inner conductor;

a rear cover assembled to the housing to enclose rear portion of the housing, the circuit board and front end of the cable;

a strain relief member assembled with the cable and the circuit board and comprising a main portion, a through hole located at the middle section thereof and at least one jointing portion formed on thereof; and wherein said at least one jointing portion of the strain relief member is soldered onto one of the conductive pads of the circuit board, the inner conductor passes through the through hole to be soldered with the circuit board, the metal braiding layer is solder onto the at least one jointing portion of the strain relief member.

2. The cable connector assembly as claimed in claim 1, wherein the strain relief member is punched from a metal sheet and comprises two jointing portions respectively formed on the two sides of the main portion, and wherein the metal braiding layer is divided into two parts respectively soldered with the two jointing portions.

3. The cable connector assembly as claimed in claim 1, wherein the terminals comprise at least one detective terminal, the circuit board further comprises an LED electrically connecting with said at least one detective terminal.

4. The cable connector assembly as claimed in claim 3, wherein the terminals are of POGO-type and comprise a pair of ground terminals, a pair of power terminals and said detective terminal.

5. The cable connector assembly as claimed in claim 4, wherein each terminal comprises a contacting portion exposed beyond front surface of the housing, a media portion engagingly received in the housing and an end portion exposed from a rear end of the housing to electrically connect with the circuit board.

6. The cable connector assembly as claimed in claim 5, wherein further comprising a cosmetic member assembled to front end of the housing and defines a plurality of channels with dimensions substantially equal to those of corresponding contacting portions of the terminals, and wherein the contacting portions protrude through corresponding channels.

7. The cable connector assembly as claimed in claim 6, wherein each terminal forms an engaging section at front end of the media portion with dimension larger than that of the media portion partially exposed beyond front surface of the housing, and wherein the cosmetic member defines a plurality of passageways corresponding to the dimensions of the engaging section and communicating with said channels to receive the engaging sections.

8. The cable connector assembly as claimed in claim 3, wherein further comprising status indicator means overlapping said LED to spread the light emitted from the LED outwardly for normal status indication.

9. The cable connector assembly as claimed in claim 8, wherein the status indicator means comprises at least a portion protruding through the rear cover to be exposed outwardly for indication.

10. The cable connector assembly as claimed in claim 8, wherein the status indicator means comprises an inner casing and a light pipe, all of which are formed by means of at least one of injection and molding from transparent or semitransparent material.

11. The cable connector assembly as claimed in claim 10, wherein the inner casing is of rectangular shape and molded with the circuit board and the strain relief member for reinforcing the stabilization of the cable connector assembly.

12. The cable connector assembly as claimed in claim 10, wherein the light pipe comprises a body section within the rear cover and a positioning section protruding through the rear cover.

13. The cable connector assembly as claimed in claim 1, further comprising a front cover made of metal material and capable of being attracted by a complementary connector, and wherein the front cover is assembled to the housing with the terminals partially exposed therein.

14. The cable connector assembly as claimed in claim 13, further comprising a cosmetic member assembled to front end of the housing received in the front cover for improving front view effect of the housing.

15. The cable connector assembly as claimed in claim 1, further comprising a stuffing member integrally made from resin material and equipped with the cable, and said stuffing member positioned at the rear portion of the rear cover.

16. The cable connector assembly as claimed in claim 15, wherein the stuffing member comprising a circular portion, a rectangular enlarged panel formed at front end of the main portion and a through hole communicating with the circular portion and the enlarged panel.

17. A cable connector assembly, comprising:

an insulative housing having a plurality of terminals disposed therein;

a circuit board assembled to the insulative housing and comprising a plurality of conductive pads soldering with said a plurality of terminals;

a cable electrically connecting with the circuit board and comprising at least an inner conductor, a metal braiding layer surrounding the inner conductor;

a rear cover assembled to the housing to enclose rear portion of the housing, the circuit board and front end of the cable;

a metallic strain relief member assembled with the cable and the circuit board, and comprising a main portion with an opening extending therethrough, and with least one jointing portion formed thereon; and wherein said at least one jointing portion of the strain relief member is electrically connected to the circuit board, the inner conductor passes through the opening to be mechanically and electrically connected with the circuit board, and the metal braiding layer is mechanically and electrically connected to the strain relief member, wherein said strain relief member essentially transversely extends perpendicular to a mating direction of said cable connector assembly.

18. The cable connector assembly as claimed in claim 17, wherein the inner conductor extends in a transverse direction on the printed circuit board parallel to said strain relief member while, perpendicular to the mating direction.

19. The cable connector assembly as claimed in claim 1, wherein said main body defines a plate-like configuration extending in a transverse direction perpendicular to a front-to-back direction defined along the passages.

20. The cable connector assembly as claimed in claim 17, wherein said main portion defines a plate-like configuration extending in a transverse direction perpendicular to said mating direction.

* * * * *

UNITED STATES PATENT AND TRADEMARK OFFICE

CERTIFICATE OF CORRECTION

PATENT NO. : 7,306,479 B1
APPLICATION NO. : 11/481644
DATED : December 11, 2007
INVENTOR(S) : Jerry Wu It is certified that error appears in the above-identified patent and that said Letters Patent is hereby corrected as shown below:

In column 8, line 38, in Claim 17, delete “least” and insert -- at least --, therefor.

In column 8, line 45, in Claim 17, delete “member,” and insert -- member; --, therefor.

In column 8, line 53, in Claim 18, delete “while,” and insert -- while --, therefor.

Signed and Sealed this
Twenty-fifth Day of October, 2011

David J. Kappos

David J. Kappos
*Director of the United States Patent and Trademark Office*